United States Patent [19]

Jones, Jr.

[11] 4,221,638

[45] Sep. 9, 1980

[54] FLUID-SOLID CONTACT VESSEL HAVING FLUID DISTRIBUTORS THEREIN

[75] Inventor: John B. Jones, Jr., Rifle, Colo.

[73] Assignee: Paraho Corporation, Grand Junction, Colo.

[21] Appl. No.: 646,573

[22] Filed: Jan. 5, 1976

[51] Int. Cl.[2] ..... C10B 1/04; C10B 47/20; F27B 1/08; F27B 1/22

[52] U.S. Cl. ..... 202/121; 34/232; 196/127; 196/133; 202/270

[58] Field of Search ..... 202/262, 263, 227, 253, 202/121, 134, 129, 135, 239, 149, 228, 270; 208/11 R; 201/29, 36–38, 43; 196/126, 127, 133, 155; 261/111; 34/232, 224; 239/566; 23/288 D, 288 G

[56] References Cited

U.S. PATENT DOCUMENTS

| | | | |
|---|---|---|---|
| 278,356 | 5/1883 | Niese et al. | 202/228 |
| 1,210,388 | 12/1916 | Wallmann | 202/262 |
| 1,690,935 | 11/1928 | Hubmann | 201/36 |
| 2,241,674 | 5/1941 | Mohr et al. | 261/111 |
| 2,873,177 | 2/1959 | Bergstrom et al. | 23/288 G |
| 3,172,823 | 3/1965 | John et al. | 202/121 |
| 3,519,539 | 7/1970 | Schulte | 201/29 |
| 3,562,143 | 2/1971 | Jagel et al. | 208/11 R |
| 3,596,884 | 8/1971 | Murphy | 261/111 |
| 3,721,608 | 3/1973 | Saller et al. | 202/121 |

*Primary Examiner*—Bradley R. Garris
*Attorney, Agent, or Firm*—Richard D. Law

[57] ABSTRACT

Rectangularly-shaped fluid distributors for large diameter, vertical vessels include reinforcers for high heat operation, vertical sides with gas distributing orifices and overhanging, sloped roofs. Devices are provided for cleaning the orifices from a buildup of solid deposits resulting from the reactions in the vessel.

6 Claims, 11 Drawing Figures

FLUID-SOLID CONTACT VESSEL HAVING FLUID DISTRIBUTORS THEREIN

This invention resulted from work done under Lease Agreement dated May 11, 1972, between the United States (represented by Honorable Rogers C. B. Morton, Secretary of the Interior) and Development Engineering, Incorporated.

Vertical kilns and other vertical-type reaction vessels are used in many different processes, and a common use of vertical kilns is the hot, gaseous treatment of rock or particulate matter passing through the kiln. In one common type of operation, particulate material is passed by gravity through the kiln by continuously feeding onto the top of a bed of the material held in a kiln and continuously removing the material from the bottom of the bed by means of a grate so as to maintain a desired depth of bed. Process gas is passed upwardly through the bed for the treatment of the rock. One example of the use of a vertical kiln is the calcination of limestone to produce lime. Another example is the retorting of kerogen in oil shale to produce shale oil. In the latter instance, the relatively small quantity of recoverable hydrocarbons in the rock requires that very large volumes of the rock or oil shale must be treated with hot gases to produce sufficient shale oil to make an economically viable process. One size of kiln for oil shale which has been recognized as economically viable hardware, is a 40-foot diameter kiln arranged to retort about 10,000 tons of oil shale per day. Such a kiln will contain a bed of shale in excess of 1,000 tons, and, obviously, the hardware must be made sufficiently strong to contain such a weight. In one process, exemplified by U.S. Pat. No. 3,841,992, dated Oct. 15, 1974, for Method for Retorting Hydrocarboneous Solids, the retort for such processes as retorting oil shale, requires the use of plurality of gas distributors mounted in at least two horizontal levels in the retort, and a number of individual distributors are required on each level to provide for a sufficient amount of gas to be introduced into the shale completely across the cross-sectional extent of the kiln. These gas distributors for effectiveness must be completely buried in the bed of the shale at predetermined heights above the grate, and they, of course, must be required to maintain their integrity under the substantial weight of the shale on them. In addition, since the kiln is operated at elevated temperatures, the material of the gas distributors must exhibit high temperature strength and/or means must be provided for the cooling of at least a portion of the gas distributors, so that the material maintains its strength.

Included among the objects and advantages of the present invention is to provide gas distribuutor systems for large scale process vessels containing a bed of a mass of heavy material to be treated.

Another object of the invention is to provide a plurality of gas distributors for large retorts wherein the gas distributors are arranged to withstand a heavy load of rock in the retort.

Another object of the invention is to provide gas distributors for large equipment so as to withstand the weight of the bed of material in the equipment whereby the gas distributors are arranged for issuing hot gas into the bed of rock or for issuing cool gas into a mass of rock subjected to combustion.

Yet another object of the invention is to provide cleaning means for the gas orifices of gas distributors for large process vessels which are subject to being clogged by products of combustion, such as coke, tar, combinations of the same, and the like.

These and other objects and advantages of the invention may be readily ascertained by referring to the following description and appended illustrations in which.

Figure 1:
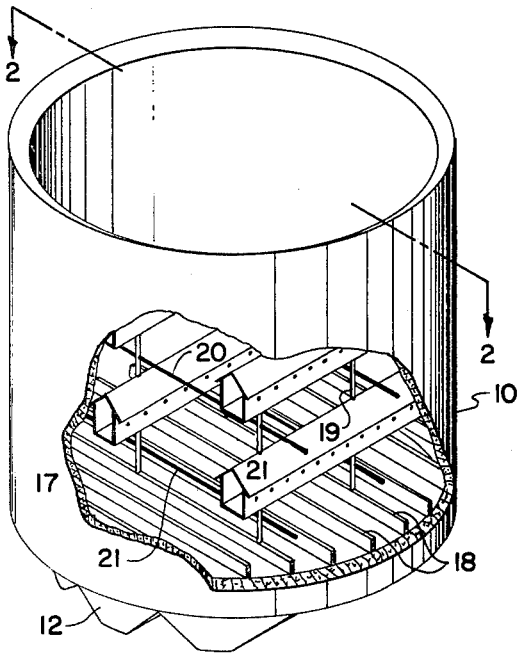
FIG. 1 is a generally schematic perspective view, partially cut away, showing the positioning of fluid distributors in a vertical process vessel.
Figure 2:
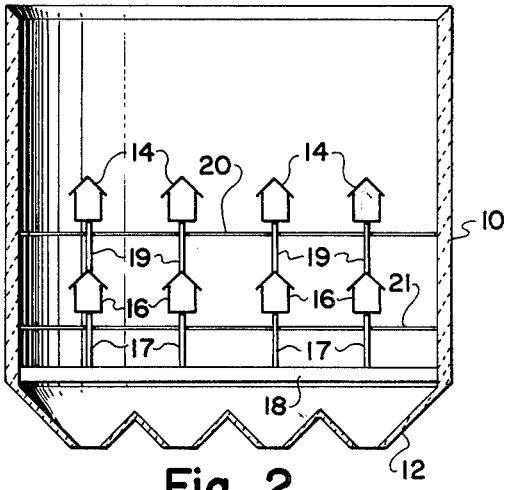
FIG. 2 is a generally schematic cross-sectional view of a vertical vessel taken along section lines 2—2 of the device of FIG. 1.
Figure 3:
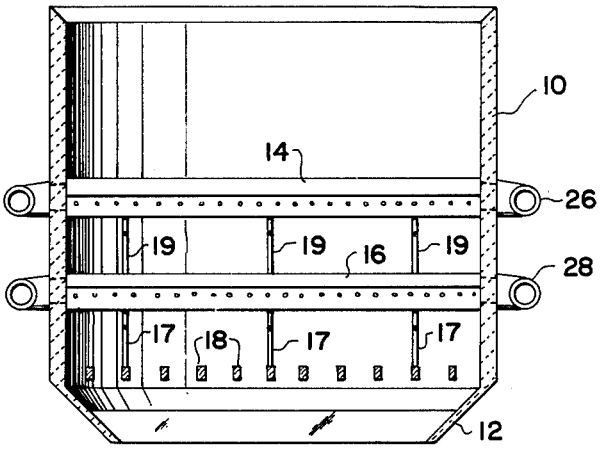
FIG. 3 is a cross-sectional view of the process vessel of FIG. 1 taken at 90° to the view of FIG. 2.

The vertical vessel illustrated in FIGS. 1–3 is generally arranged as kiln and includes a refractory lined wall 10 having a metal kiln skin both being of sufficient strength to contain a bed of a large amount of the material for processing. As pointed out above, a 40-foot diameter kiln having about a 27-foot depth bed will contain about 1,000 tons of shale, and the construction of the vessel obviously must be sufficient to contain this weight. The kiln normally contains a closed top (not shown) through which is fed rock and for the collection of gases issuing from the process, and a grated bottom 12 for the release of the processed rock. A grate mechanism is required for supporting the rock and for releasing a controlled continuous flow of the rock, for maintaining a bed under gravity flow of the rock through the kiln. The grate mechanism is not part of the invention, and it is, therefore, not shown in the kiln, but such a grate as shown in the U.S. Pat. No. 3,401,922, issued Sept. 17, 1968, may be provided for containing the rock in the kiln . One set of plurality of gas distributors 14 are mounted in a generally horizontal plane in the kiln above a lower set of a plurality of gas distributors 16, also, mounted in a generally horizontal plane in the kiln. The lower distributors 16 are supported on spaced supports 17, which in turn are mounted on internal cross member supports 18. Spaced supports 19 extend upwardly from the distributors 16 and support the distributors 14 thereabove. The number of supports necessary for supporting the load in the kiln is determined by materials engineering. Spaced lateral supports 20 provide lateral stability for the upper gas distributors, and lateral supports 21 provide lateral stability for the lower distributors. The lateral supports extend from the side of the vertical vessel to the vertical supports and prevent lateral movement of the gas distributors as the rock passes through the spaces between the distributors and/or the wall of the vessel. The upper gas distributors are fed a fluid stream by means of a circular manifold 26 which provides leads through the wall into both ends of each distributor. The circular manifold feeds both ends of the distributors to provide sufficient fluid for the process and to prevent an undue pressure drop through the distributors. In a similar manner, the lower distributors are fed by a circular manifold 28, which, likewise, feeds each distributor through both ends.

Figure 4:
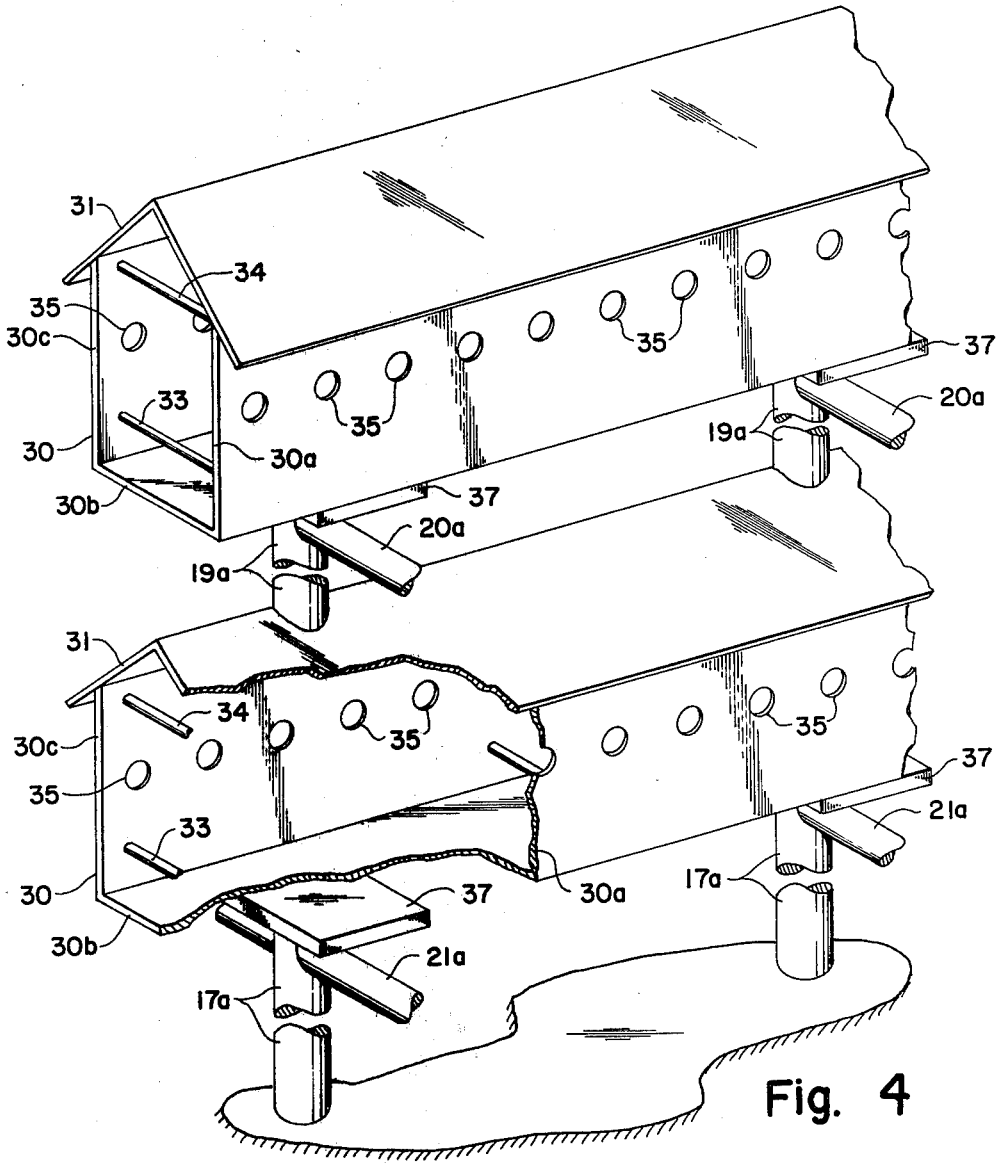
FIG. 4 is an enlarged detailed view, partially cut away, of one form of fluid distributors for use in large diameter process vessels.

As illustrated in FIG. 4, the gas distributors are channel-shaped members mounted with their opening in the upper most position. A peaked top covering is secured over the opening to provide a closed unit. The upper distributor is formed of an elongated channel member 30, which is arranged to extend from sidewall to sidewall of a vertical vessel, and the opening of the channel member is closed by a peaked roof 31. The peak of the roof is mounted centrally of the opening, and it is secured as by welding or the like to the ends of the sidewalls of the channel. Spaced lateral supports 33 extend internally along the upper part of the channel for bracing the sidewalls against the weight of the rock pressing against the distributor. The channel 30 includes vertical sides 30*a* and 30*c* and joining web member 30*b*. Each of the sides 30*a* and 30*c* include a series of spaced orifices 35 extending along the wall under the overhang of the peaked top 31, which permits the gas fed into the distributor to issue into rock in the vessel. As shown in FIG. 2, the gas distributors are stacked one above the other with a series of distributors in one plane forming the upper gas distributors, and a series mounted on a plane below the upper distributors for providing the lower distributors in a vessel. The distributors, FIG. 4, are spaced apart and braced by means of upper brace members 19*a*, and are supported from the bottom of the kiln by means of lower supports 17*a*. Lateral stability is provided by means of lateral supports 20*a* adjacent the upper distributors and by lateral supports 21*a* on the lower distributors. Pads 37 mounted on the bottom of the gas distributors provides additional reinforcing for the bottom of the distributors.

The distributors illustrated in FIG. 4 have been found useful for retorting oil shale, wherein a hot gas is fed from the distributors into the cooler shale. The distributors may be insulated, if desired. The gas from both sets of distributors has a controlled quantity of oxygen so that retorting occurs above both distributors. Gas passing upwardly through the shale heats the shale above the retorting zone. The cooler gases passing upwardly from the bottom of the kiln cools the distributors. The cooler gases from the kiln bottom cool the support steel as well as the cooler shale in the bed. The cooling, however, is sufficiently cool to maintain the strength integrity of the steel of the gas distributor and the supporting structure.

Figure 5:
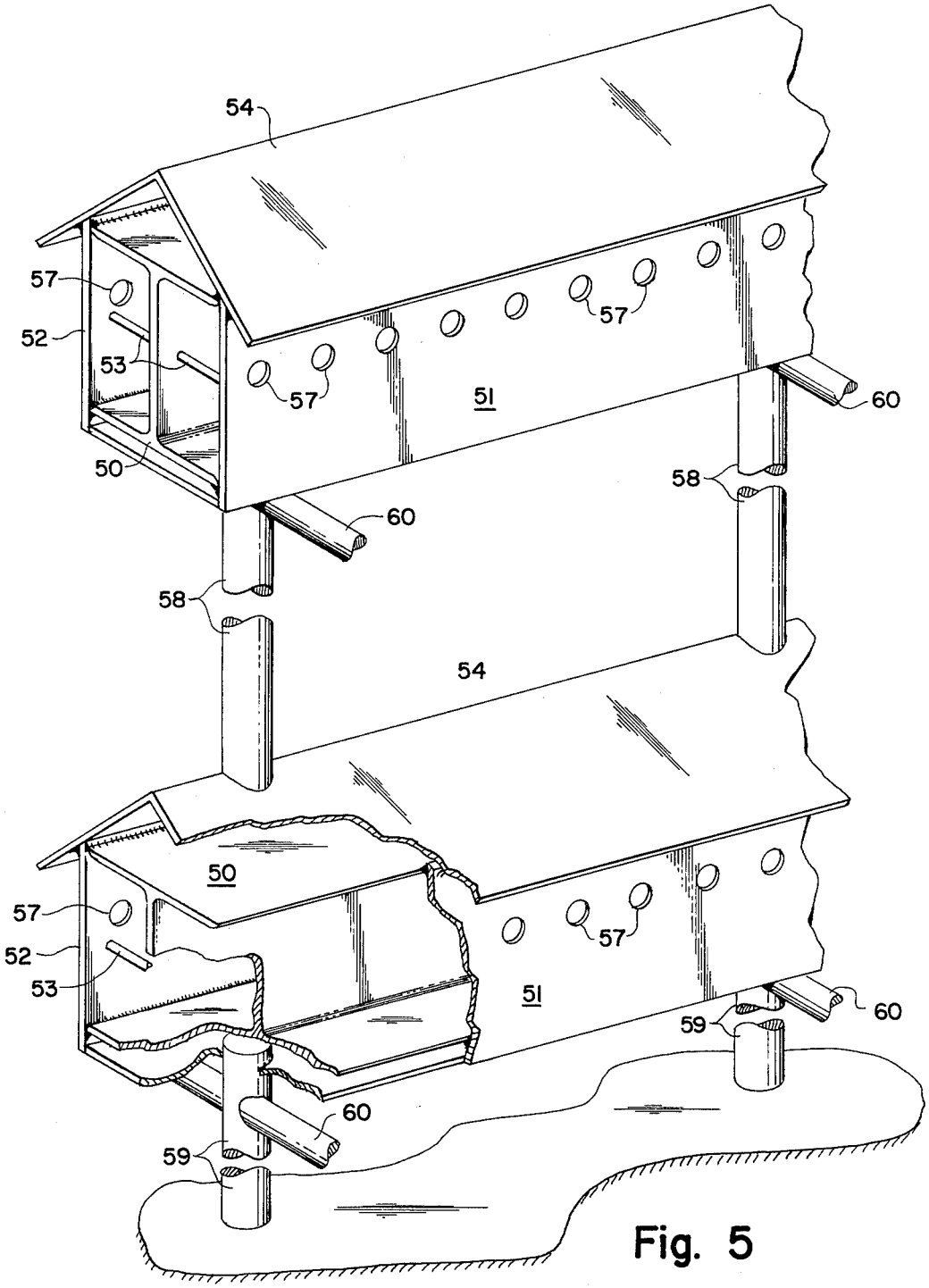
FIG. 5 is a detailed view of a modified form of fluid distributor for large process vessels.

In the distributors shown in FIG. 5, an H-section beam 50, with its web vertical, is provided with side 51 and 52 secured by welding to the tips of the H, providing a divided box-type distributor with a pair of passages therethrough. A plurality of spaced reinforcing bars 53 extend through the web of the H-section beam and support the outer walls of the distributor. A peak roof 54 is provided over the distributor preventing accumulation of solid material thereon. The angle of the intersecting sides of the cover is sufficiently greater than the angle of repose of the material providing for a flow of the material down the sloped cover. The sidewalls are provided with spaced orifices 57 therealong for distributing gas into the vertical vessel. The upper distributor is supported by means of supports 58 on the lower distributor and the lower distributor is mounted on supports 59. The lower supports, of course, are mounted on reinforcing members in the bottom of the vessel, and the two sets support the gas distributors against the weight of the rock in the vessel. Lateral supports 60 extend from distributor to distributor below each of the upper and lower sets and to the sidewall of the vessel, as pointed out for the distributors above to prevent lateral movement of the distributors. The distributors of this modification are particularly useful for a direct mode of retorting, wherein cooler gases are fed through the distributor into the material being retorted by means of combustion. The inner web helps provide support for the upper and lower plates of the H section, and since the cooler gas is inside the distributors, the sidewalls are, also, cooled for maintaining the strength of the distributor steel. For example, in an oil shale retorting by means combustion, the temperatures in the bed may be in excess of 1200° F. However, liquid cooling lines may be affixed with circulating fluid to the web or flanges for maintaining them cooler, or insulation may be fixed to exterior of the distributors.

Figure 7:
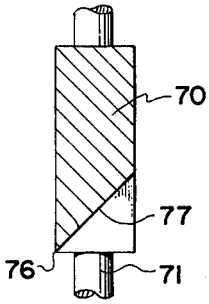
FIG. 7 is a cross-sectional view of the device of FIG. 6 taken along section line 7—7.
Figure 8:
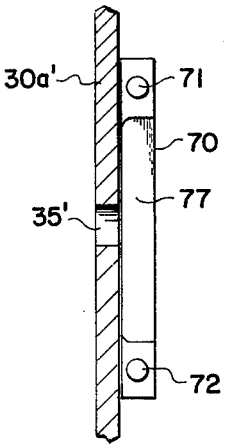
FIG. 8 is an end view of the scraping device of FIG. 6.
Figure 6:
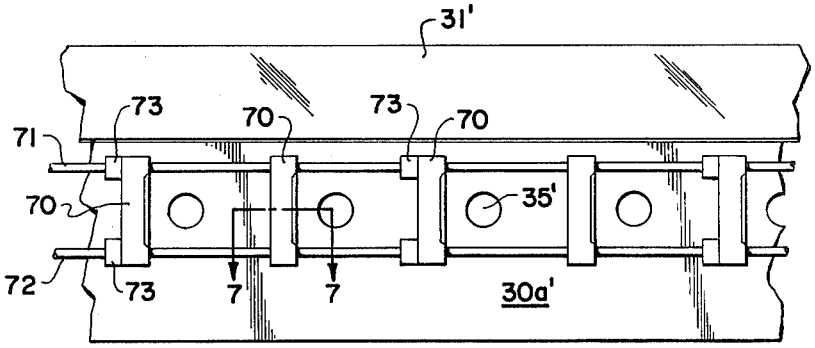
FIG. 6 is a detailed view of scraper arrangements for cleaning the orifices in a vertical side of a fluid distributor.

In any kiln operation, particularly on retorting oil shales, an accumulation of coke, tar or other hard burn material tends to build up around the orifices. It has been found that with either an indirect retorting, wherein hot gases are used to retort the oil shale, or for direct retorting, where actual combustion occurs in the oil shale outside of the distributors, there is a substantial buildup of material around the orifices and in many cases tend to completely close the orifices. As shown in FIGS. 6 through 8, a scraping arrangement is provided so that a scraping blade moves across each orifice to maintain the orifice clear from any buildup of material. A distributor having a sidewall 30*a* and a sloped cover 31' is provided with a series of spaced orifices 35' for dispensing gases into the rock in the vertical vessel. A scraping blade 70 is provided adjacent each orifice 35' and attached to a pair of drive rods 71 and 72 that are passed through the scraper 70 so that on movement of the rods, the scrapers move across the orifices in the wall 30*a*. For holding the scrapers tightly against the wall, loops 73 are secured to the wall in various places along the rods, so as to hold each of the scrapers tightly against the wall. The activating rods 71 and 72 may be moved by any convenient drive means, and they should be moved periodically, normally every few minutes, to maintain each orifice clean from any buildup of the material. Each scraper 70 includes a scraping edge 76 which passes over the orifices for maintaining the opening clear of foreign matter. The sloped face 77 extending rearwardly of the scraping edge forces any scraped-off material into the shale bed, and it is subsequently burned or discharged with the shale.

Figure 9:
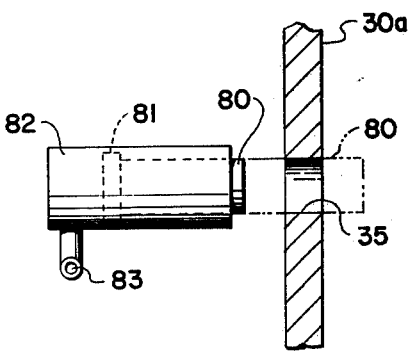
FIG. 9 is a generally schematic view of one form of plunger or ram for cleaning gas orifices in the side of a gas distributor.
Figure 10:
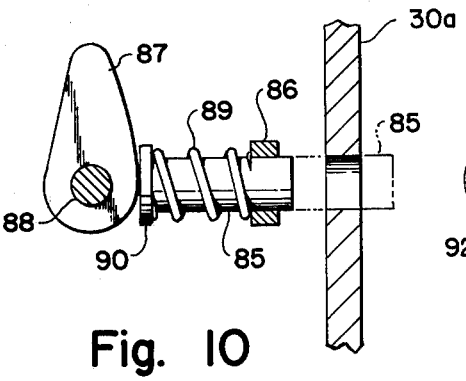
FIG. 10 is a modified form of an orifice cleaning ram comprising a rotary cam for activation.

Another method of maintaining the orifices open is shown in FIG. 9 wherein a sharp edged piston rod or ram 80 is arranged to pass through the opening 35 in distributor wall 30*a*. The scraper end 80 may be attached to a piston 81, which is mounted in a cylinder 82 so that hydraulic fluid passed into the cylinder 82 through a supply line 83 forces the piston outwardly, clearing the hole. A double-acting cylinder is, of course, of value in extension and retraction of the piston. The ram may, also, be moved by means of a cam 87, FIG. 10, which is mounted on a rod 88 in the distributor. Ram 85, in guide 86, moves outwardly to clear the orifice. Rotation of the rod turns the cam which forces the cleaner ram through the orifice, and a spring load 89 between guide 86 and flange 90 returns the cleaner ram back for additional extensions. It is understood that each orifice is provided with scraper means for maintaining all of the orifices open by the periodic movement of the scrapers through the orifices. By providing the cams at different degree settings on the rod, the cleaner rams may be made to move sequentially or in succession so that not all of the orifices are plugged by the rams at the same time.

Figure 11:
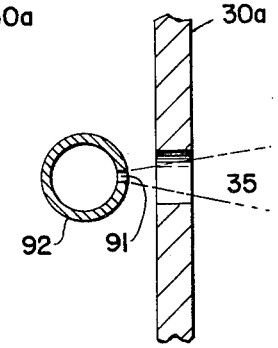
FIG. 11 is a generally schematic view, in section, of a high pressure fluid jet arranged for cleaning the gas orifices of a gas distributor according to the invention.

As shown in FIG. 11, a high velocity stream of liquid is arranged to clean the orifices, wherein a high pressuure line 92 is provided with a jet 91 in communication with the inside of the line and directed toward the opening 35 in the gas distributor. The high velocity fluid may be pulsed for periodically cleaning the orifices. By providing a timed pulse based on the particular operation, the opening may be effectively maintained clear during the retorting. The positioning or location of holes, in a vertical direction, is a function of the type of treatment being given to the rock in kiln. Also, the insulation, which may be on inside of distributor side walls, or on the outside depending on the mode of operation, may be conformed to the orifices and still permit maintaining them open. Thus, when the insulation is on the outside, a metal covering may be used when the scrapers are used.

What is claimed is:

1. Fluid distribution means for large generally circular vessels having large uninhibited volumes normally filled with particulate matter, comprising:

(a) hollow passage means rigidly mounted and extending from one side to the opposite of a vessel;

(b) said hollow passage means being defined by a beam having a cross-section at least similar in shape to an H having a vertical web and adequate strength to carry a load imposed on it, and being further defined by vertical, planar sidewalls secured to the open sides of said beam, said sidewalls having a series of spaced fluid distribution orifices therethrough;

(c) peaked cover means extending over the top of the hollow passage means and providing an overhanging lip over each generally vertical sidewall preventing direct impingement of particulate matter on a major portion of each sidewall;

(d) means for rigidly mounting said hollow passage means within a vessel comprising a series, of vertical supports secured at intervals to the outside and at the bottom of said hollow passage means for preventing movement of said hollow passage means; and (e) reinforcing means in said hollow passage means for supporting said generally vertical sidewalls.

2. A fluid distribution means according to claim 1, wherein the slope of each side of said cover means is at an angle greater than the repose angle of the particulate matter.

3. A fluid distribution means according to claim 1 wherein means are provided for introducing fluid into at least one of said passage means.

4. A large generally circular vessel normally filled with particulate matter comprising:

(a) a series of hollow fluid distribution passage means mounted in the vessel and extending from one side to the opposite side of the vessel;

(b) each said hollow passage means being defined by an H-beam having an upright web and adequate strength to carry a load on it, and being further defined by generally vertical, planar sidewalls, secured to the open sides of said H-beam, said sidewalls having a series of spaced fluid distribution orifices therethrough;

(c) peaked cover means extending over the top of the hollow passage means and providing an overhanging lip over each said generally vertical sidewall preventing direct impingement of particulate matter on a major portion of each sidewall;

(d) means for rigidly mounting said hollow passage means within a vessel comprising a series, of vertical supports secured at intervals to the outside and at the bottom of said hollow passage means for preventing movement of said hollow passage means; and (e) reinforcing means in said hollow passage means for supporting said generally vertical sidewalls.

5. A vessel according to claim 4, wherein said series of fluid distribution orifices are arranged in at least two horizontal planes.

6. A vessel according to claim 5, wherein the vertical supports extend from said distribution passage means in one plane to said distribution passage means in the other plane.

* * * * *